US012104485B2

(12) United States Patent
Li et al.

(10) Patent No.: US 12,104,485 B2
(45) Date of Patent: Oct. 1, 2024

(54) DRILLING SYSTEM THAT MEASURES THE FLUID LEVEL IN A WELLBORE DURING DRILLING OF THE WELLBORE

(71) Applicant: SAUDI ARABIAN OIL COMPANY, Dhahran (SA)

(72) Inventors: Bodong Li, Dhahran (SA); Timothy Eric Moellendick, Dhahran (SA); Chinthaka Pasan Gooneratne, Dhahran (SA); Abdulaziz Almusa, Dhahran (SA); Guodong Zhan, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/065,361

(22) Filed: Dec. 13, 2022

(65) Prior Publication Data

US 2024/0191615 A1 Jun. 13, 2024

(51) Int. Cl.
*E21B 47/047* (2012.01)
*E21B 47/095* (2012.01)
*E21B 47/13* (2012.01)

(52) U.S. Cl.
CPC ..... *E21B 47/047* (2020.05); *E21B 47/095* (2020.05); *E21B 47/13* (2020.05)

(58) Field of Classification Search
CPC ..... E21B 47/047; E21B 47/13; E21B 47/095
See application file for complete search history.

(56) References Cited

U.S. PATENT DOCUMENTS 6,176,323 B1 * 1/2001 Weirich ..... E21B 44/005 175/40
9,404,327 B2 * 8/2016 Rasmus ..... G01V 9/00
2012/0084055 A1 * 4/2012 Smithson ..... F04B 49/02 702/166

(Continued)

FOREIGN PATENT DOCUMENTS

CN 103089249 B 7/2015
CN 105275454 A 1/2016

(Continued)

OTHER PUBLICATIONS

International Search Report issued in corresponding International Application No. PCT/US2023/083881; mailed Apr. 2, 2024 (6 pages).

(Continued)

*Primary Examiner* — Taras P Bemko
(74) *Attorney, Agent, or Firm* — Osha Bergman Watanabe & Burton LLP

(57) ABSTRACT

A drilling system measures a fluid level in a wellbore. The drilling system may include a drill pipe and a sensor sleeve attached to the drill pipe. The sensor sleeve may include a transmitter that transmits a sensing signal in a direction of a fluid in the wellbore, a receiver that receives the sensing signal after the sensing signal is reflected on a surface of the fluid, and a repeater that determines a distance between the sensor sleeve and the fluid level from the transmitted and received sensing signal. The fluid level in the wellbore may be calculated using the distance determined by the repeater and a distance between the sensor sleeve and a surface of the wellbore.

16 Claims, 7 Drawing Sheets

(56) References Cited

U.S. PATENT DOCUMENTS

| | | | | |
|---|---|---|---|---|
| 2013/0026766 | A1* | 1/2013 | Ocalan | H02K 7/1853 290/1 R |
| 2014/0124210 | A1* | 5/2014 | Dowell | E21B 47/047 166/336 |
| 2017/0160411 | A1* | 6/2017 | Golparian | G01V 1/52 |
| 2018/0305993 | A1* | 10/2018 | Perkins | E21B 47/00 |
| 2019/0136688 | A1* | 5/2019 | Costa De Oliveira | E21B 47/26 |
| 2020/0240265 | A1* | 7/2020 | Machocki | E21B 47/06 |
| 2021/0349231 | A1 | 11/2021 | Griffing et al. | |
| 2022/0034198 | A1* | 2/2022 | Gooneratne | G01V 11/002 |
| 2022/0390637 | A1* | 12/2022 | Yogeswaren | E21B 47/0025 |
| 2023/0235661 | A1 | 7/2023 | Affleck et al. | |

FOREIGN PATENT DOCUMENTS

| | | | |
|---|---|---|---|
| CN | 107605463 | A | 1/2018 |
| CN | 111364980 | A | 7/2020 |
| CN | 114109365 | A | 3/2022 |
| WO | 2016209229 | A1 | 12/2016 |
| WO | 2021236121 | A1 | 11/2021 |

OTHER PUBLICATIONS

Written Opinion of the International Searching Authority issued in corresponding International Application No. PCT/US2023/083881; dated Apr. 2, 2024 (7 pages).

* cited by examiner

DRILLING SYSTEM THAT MEASURES THE FLUID LEVEL IN A WELLBORE DURING DRILLING OF THE WELLBORE

BACKGROUND

Circulation loss is the uncontrolled flow of mud (drilling fluid) from the wellbore into the formation. During the drilling of oil and gas wells, circulation loss is commonly encountered. Circulation loss occurs in formations that are inherently fractured, cavernous, have high permeability, or are induced by improper drilling conditions, or drilling practices. In extreme cases, such as total circulation loss, there is zero return of the drilling fluid at the surface. In case of total circulation loss, the fluid level in the annular space between the casing of the wellbore and the tubing, where drilling fluid flows, is always below the outlet of the flow line to the mud tank. Under such circumstances, it is difficult to identify the actual fluid level which is a key parameter to calculate pore pressure of fluids within the pores of a reservoir. It is also difficult to identify the pressure required to induce fractures in rock at a given depth (fracture gradient) of shallow formations.

To maintain a hydrostatic pressure in the well for safety and wellbore integrity, drilling systems normally pump the drilling fluid, in addition to the conventional flow of drilling fluid from the drill pipe, from the back end of the tubing directly into the annulus. When the fluid level is unclear, it is impossible to make informed decisions on the required pump rate and the mud density. The determination of the fluid level in the wellbore determines the mud cap parameters, which will lead to savings and improved wellbore conditions if reducing mud cap rate or density is possible. The determination of the fluid level when all the drilling fluid pumped down the wellbore is lost (total loss of the drilling fluid) will also help making informed decisions on setting the depth of the differential valve (DV) tool, considering DV packer differential limitations, and hydrostatic supporting pressure of the fluid in the wellbore. This will lead to cost saving and reduction in the failure rate of the DV tool.

Accordingly, there exists a need for a drilling system that measures the fluid level in a wellbore during drilling of the wellbore.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a drilling system that measures a fluid level in a wellbore. The drilling system may include a drill pipe and a sensor sleeve attached to the drill pipe. The sensor sleeve may include a transmitter that transmits a sensing signal in a direction of a fluid in the wellbore, a receiver that receives the sensing signal after the sensing signal is reflected on a surface of the fluid, and a repeater that determines a distance between the sensor sleeve and the fluid level from the transmitted and received sensing signal. The fluid level in the wellbore may be calculated using the distance determined by the repeater and a distance between the sensor sleeve and a surface of the wellbore.

In another aspect, embodiments disclosed herein relate to a drilling system that measures a fluid level in a wellbore. The drilling system may include a drill pipe comprising a sensor sleeve attached to the drill pipe, the drill pipe being configured to be lowered into the wellbore where a drilling fluid circulates. The sensor sleeve may include a pressure gauge that measures a hydrostatic pressure of the drilling fluid in the wellbore, and a repeater that determines a depth of the sensor sleeve in the drilling fluid based on the hydrostatic pressure and a density of the drilling fluid.

In yet another aspect, embodiments disclosed herein relate to a method of measuring a fluid level in a wellbore during drilling of the wellbore using a drilling system comprising a drill pipe. The method may include attaching a plurality of sensor sleeves along the drill pipe and drilling the wellbore with the drill pipe, while filling the wellbore with drilling fluid. The method may also include measuring the fluid level in the wellbore in time intervals by: transmitting a sensing signal from each sensor sleeve in a direction of the fluid level, receiving, by the plurality of sensor sleeves, each sensing signal reflected on the surface of the drilling fluid, determining a distance between each sensor sleeve and the fluid level from the transmitted and received sensing signals, determining the sensor sleeve that is closest to and above the fluid level, called the offset sensor sleeve, determining a fluid level offset, wherein the fluid level offset is a length of the drill pipe from the offset sensor sleeve to a surface of the wellbore, and determining the fluid level by adding the fluid level offset and the distance between the offset sensor sleeve and the fluid level.

Other aspects and advantages of the claimed subject matter will be apparent from the following description and the appended claims.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In one aspect, embodiments disclosed herein relate to a drilling system that measures a fluid level in a wellbore, comprising: a drill pipe, wherein a sensor sleeve is attached to the drill pipe, and the sensor sleeve comprises: a transmitter that transmits a sensing signal in a direction of the fluid, a receiver that receives the sensing signal after the sensing signal is reflected on a surface of the fluid, and a repeater that determines a distance between the sensor sleeve and the fluid level from the transmitted and received sensing signal.

More specifically, the system includes a finite number of repeaters installed along the drill pipe in a format of sensor sleeves. The repeaters are electronic modules each equipped with on-board powering, computation, communication and sensing modules. The spacing between the neighbouring repeaters can be anywhere between one joint to a hundred joints (drill pipes) depending on the wellbore geometry. Each repeater has its unique ID that is correlated with drill pipe tally thus its position/depth can be identified at any time provided the ID number. The fluid level offset is measured by the sensors of the repeater that has the closest proximity to the fluid level. Once the fluid level offset is identified, the total fluid level is a sum of the repeater's position and the offset value. The data is transmitted among the repeaters by mean of optical communication.

Embodiments of the present disclosure may provide at least one of the following advantages. The drilling system measures the fluid level in a wellbore during drilling of the wellbore, even during total loss of the drilling fluid in the wellbore.

Figure 1:
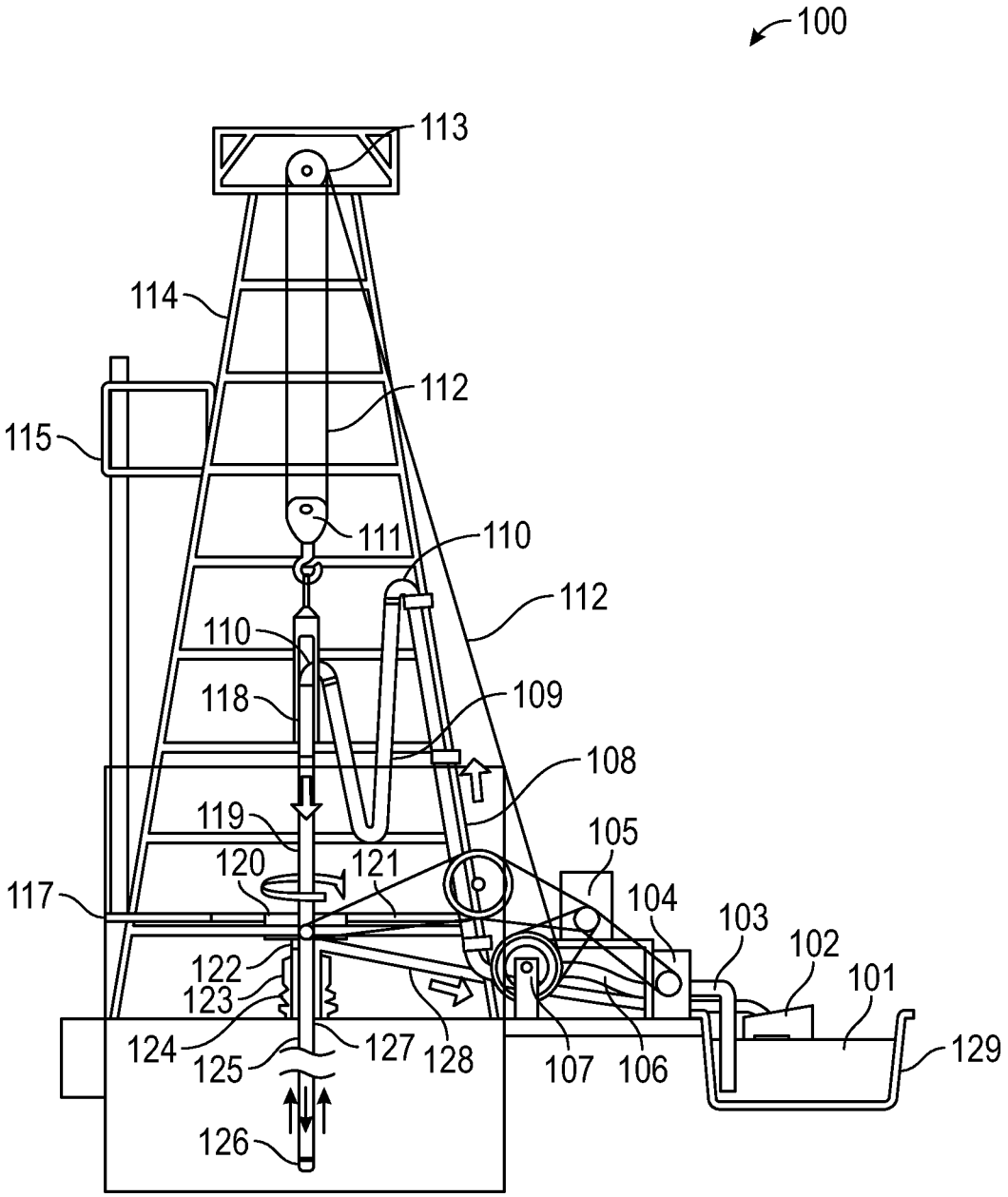
FIG. 1 shows a schematic view of the drilling system, according to one or more embodiments.

FIG. 1 provides a schematic cross-sectional view of the drilling system 100 in accordance with one or more embodiments disclosed herein.

The drilling system 100 includes a derrick 114 with a block and tackle which includes a crown block 113, and a traveling block 111. The crown block 113 is the stationary end of the block and tackle and the traveling block 111 is the moving end of the block and tackle. For raising or lowering the traveling block 111, the drilling system 100 includes drawworks 107 with a spool that reels a drill line 112 in or out. The drill line 112 is a thick, stranded metal cable and is threaded between the crown block 113 and the traveling block 111. The traveling block 111 includes sheaves that move up and down the derrick 114. A wire rope is threaded through the sheaves and goes back to the crown block 113. This pulley system enables a drill string 125 to be lifted out of or lowered into the wellbore. A racking board 115 provides a catwalk along the side of the derrick 114. The racking board 115 is 35 to 40 feet long and begins from a floor 121 which is the main area where work is performed.

The drill string 125 is an assembled collection of a drill pipe, a heavy weight drill pipe, drill collars, and tools, connected and run into the wellbore to facilitate the drilling of the wellbore. The drill string 125 includes a drill bit 126, which is attached to the end of the drill string 125, that drills and breaks the rocks apart. The drill bit 126 contains jets through which the drilling fluid 101 exits. A hydraulically powered mud motor (not shown in FIG. 1) is positioned above the drill bit 126 and spins the drill bit 126 independently from the rest of the drill string 125.

A swivel 118 is hooked to the traveling block 111, which is the top end of a kelly, and allows the rotation of the drill string 125 without twisting the traveling block 111. A square, hexagonal or octagonal shaped tubing, called kelly drive 119, is attached to the swivel 118. The kelly drive 119 is inserted through and is an integral part of a rotary table 120 that moves freely vertically while the rotary table 120 turns it. The interaction between the kelly drive 119 and the rotary table 120 is described more detailed in the description of FIG. 2A.

The rotary table 120 rotates the kelly, a kelly bushing, the drill string, and the attached tools and the drill bit. The kelly is a long square or hexagonal steel bar with a hole drilled through the middle for conduit of the drilling fluid 101. The kelly is used to transmit rotary motion from the rotary table 120 or the kelly bushing to the drill string, while allowing the drill string to be lowered or raised during rotation. The kelly goes through the kelly bushing, which is driven by the rotary table 120. The kelly bushing has an inside profile matching the kelly's outside profile, which is either square or hexagonal, but with slightly larger dimensions so that the kelly can freely move up and down inside.

The kelly bushing is an adapter that connects the rotary table 120 to the kelly. The kelly bushing has an inside diameter profile that matches the outside diameter of the kelly. The kelly bushing is connected to the rotary table 120 by four large steel pins that fit into mating holes in the rotary table 120. The rotary motion from the rotary table 120 is transmitted to the kelly bushing through the pins, and then to the kelly itself through the square or hexagonal flat surfaces between the kelly and the kelly bushing. The kelly then turns the entire drill string because it is screwed into the top of the drill string itself.

Blowout preventers (BOPs, not shown in FIG. 1) prevent fluids and gases from unintentionally escaping from the wellbore. The blowout preventers include an annular 123, and pipe rams and blind rams 124. A large pipe, called bell nipple 122, is disposed on top of the blowout preventers. A large diameter flow line 128 is attached to the bell nipple 122 via a side outlet to allow the drilling fluid to flow back to the mud tank 129. The mud tank 129 or mud pit stores drilling fluid 101 until the drilling fluid 101 is required down the wellbore. A shale shaker 102 separates drill cuttings from the drilling fluid 101 before it is pumped downhole the wellbore. A mud pump 104 circulates drilling fluid 101 through the drilling system 100. A suction line 103 draws drilling fluid 101 from the mud tank 129 to the mud pump 104. A flexible, high pressure vibrating hose 106 connects the mud pump 104 to a standpipe 108. The vibrating hose 106 vibrates and shakes due to its close proximity to the mud pump 104. The flow line 128 is attached to the bell nipple 122 and extends to the shale shaker 102 to facilitate the flow of drilling fluid 101 back to the mud tank 129.

The standpipe 108 is a thick metal tubing and is arranged vertically along the derrick 114. The standpipe 108 facilitates the flow of drilling fluid 101. The standpipe 108 is attached to and supports one end of a kelly hose 109. The kelly hose 109 is a flexible, high pressure hose that connects the standpipe 108 to a gooseneck 110 on the swivel 118 above the kelly and allows free vertical movement of the kelly, while facilitating the flow of the drilling fluid 101 down the drill string 125. The gooseneck 110 is a thick metal elbow connected to the swivel 118 and the standpipe 108, that supports the weight of and provides a downward angle for the kelly hose 109 to hang from.

A setback 117 is a part of the drill floor 121 where a stand of the drill pipe stays upright. The setback 117 is made of a metal frame with large wooden beams disposed within the setback 117. The wood helps to protect the end of the drill pipe. Elevators (not shown in FIG. 1) are latched to the drill pipe for lowering and lifting the drill pipe into or out of the wellbore.

A large metal flange, called a casing head 127, is welded or screwed on top of the casing and is used to bolt the surface equipment such as the blowout preventers. A degasser (not shown in FIG. 1) is mounted on top of the mud tank 129 and separates air, gas, or both from the drilling fluid 101. In some embodiments, a desander or desilter (not shown in FIG. 1) is mounted on top of the mud tank 129 and contains a set of hydrocyclones that separate sand and silt from the drilling fluid 101. In other embodiments, a centrifuge (not shown in FIG. 1) separates fine silt and sand from the drilling fluid 101. The centrifuge is mounted on top or off of the mud tank 129.

Figure 2A:
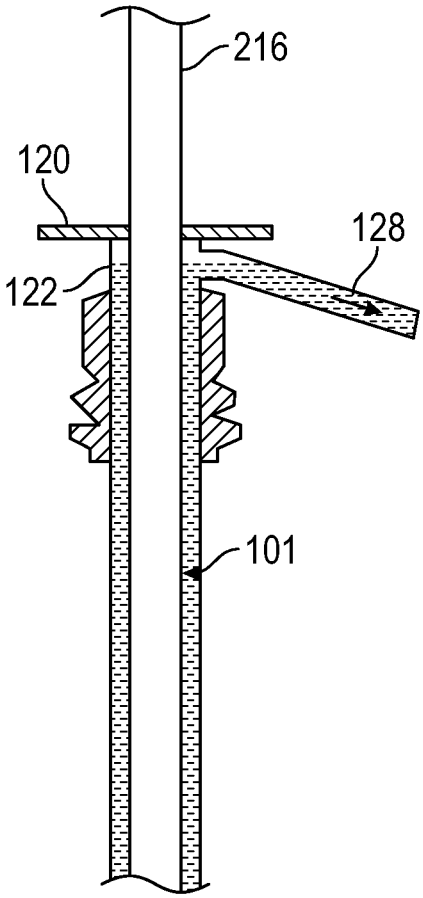
FIG. 2A shows a magnification of the drill pipe of FIG. 1 at the rotary table with full circulation of the drilling fluid, according to one or more embodiments.

FIG. 2A shows a magnification of the drill pipe 216 of FIG. 1 at the rotary table 120 with a high level of drilling fluid 101. The drill pipe 216 rotates inside the tubular-shaped bell nipple 122. The space between an outer surface of the drill pipe 216 and an inner surface of the bell nipple 122 is called annulus.

As described in the description of FIG. 1, the drilling fluid 101 is pumped from the mud tank 129 down the wellbore to the drill bit and flows up the annulus to the flow line 128 and from the flow line 128 back to the mud tank 129. The flowing of the drilling fluid 101 from the mud tank 129 to the drill bit and from the drill bit back to the mud tank 129 is called the circulation of the drilling fluid 101.

In case the amount of drilling fluid 101 flowing out of the wellbore to the mud tank 129 through the flow line 128 is the same as the amount of the drilling fluid pumped down the wellbore, there is no circulation loss of the drilling fluid 101 in the wellbore and the drilling fluid 101 is fully circulating and the level of the drilling fluid is at the flow line 128.

Figure 2B:
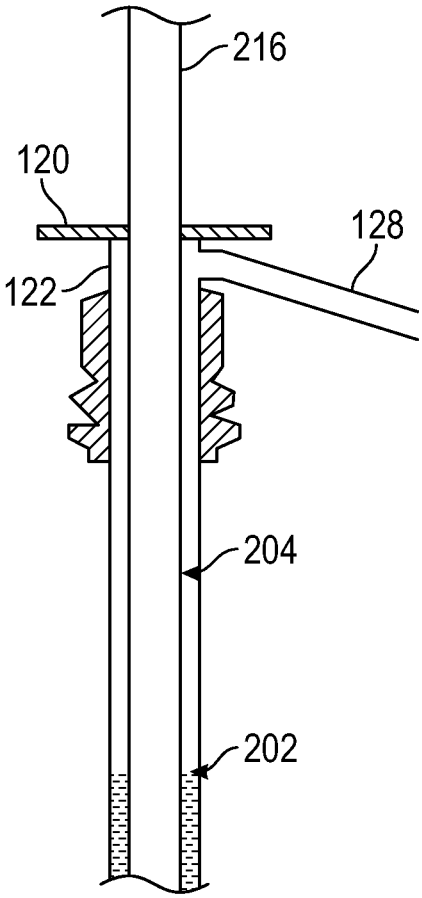
FIG. 2B shows a magnification of the drill pipe of FIG. 1 at the rotary table with total loss of the drilling fluid, according to one or more embodiments.

FIG. 2B shows the annulus of FIG. 2A with a low level of the drilling fluid 101. In this case the amount of drilling fluid 101 flowing out of the wellbore to the mud tank 129 through the flow line 128 is less than the amount of the drilling fluid 101 pumped down the wellbore, there is circulation loss of the drilling fluid 101 in the wellbore and the drilling fluid 101 is partly circulating and the level of the drilling fluid is somewhere between the flow line 128 and the bottom of the annulus. In this case, drilling fluid 101 needs to be refilled in the mud tank 129 from time to time in order to keep the level of the drilling fluid 101 as high as the flow line 128 to keep the drilling fluid 101 fully circulating.

In case all of the amount of the drilling fluid 101 pumped down the wellbore is lost in the wellbore, the drilling fluid 101 is lost totally and the level of the drilling fluid drops to the bottom of the annulus. In this case, not even a refill is able to keep the circulation of the of the drilling fluid 101.

Figure 3C:
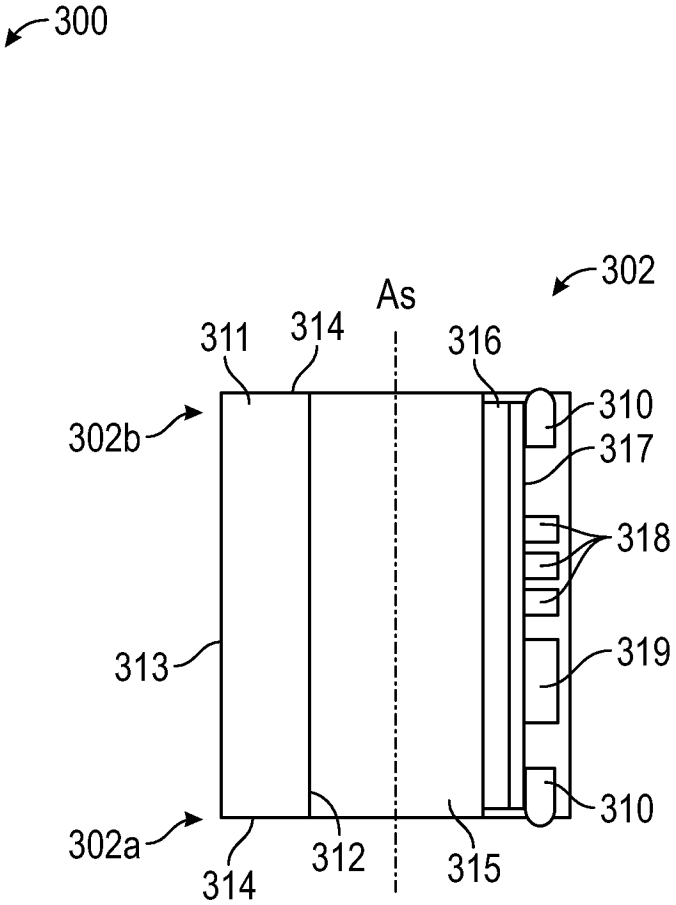
FIG. 3C shows a cross-sectional view of a sensor sleeve according to one or more embodiments.
Figure 3B:
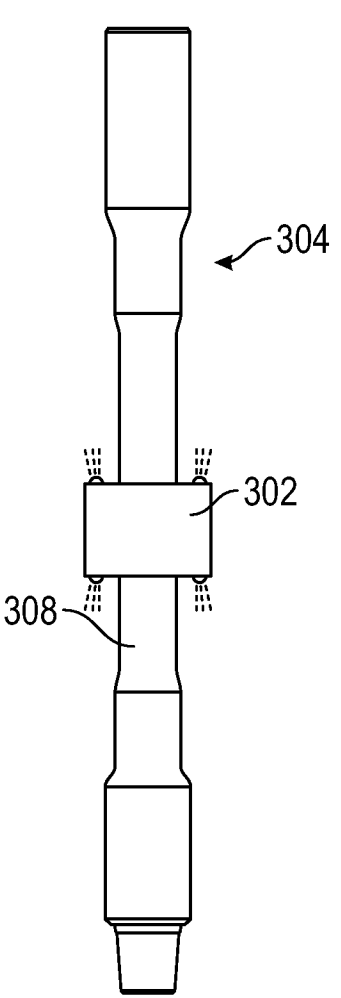
FIG. 3B shows a schematic view of the drilling system including a drill pipe with a sensor sleeve disposed on a middle portion of the drilling system, according to one or more embodiments.
Figure 3A:
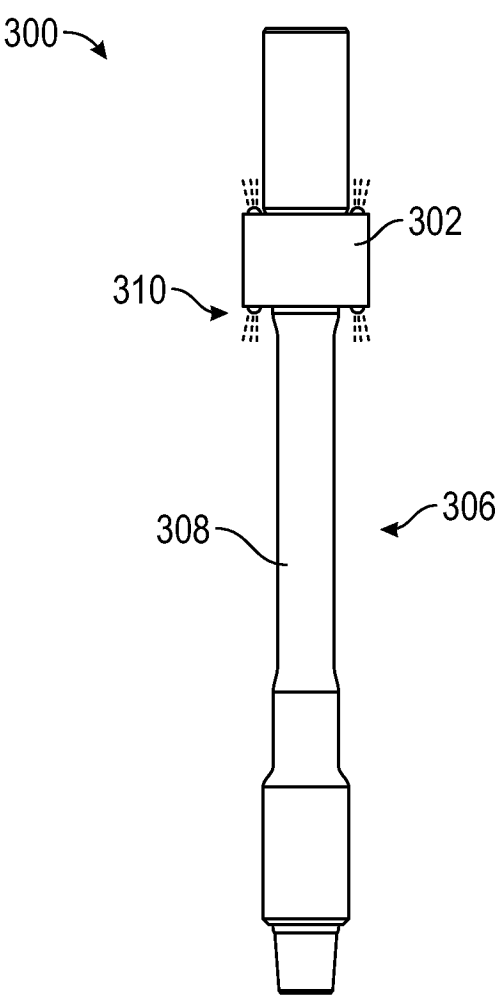
FIG. 3A shows a schematic view of the drilling system including a drill pipe with a sensor sleeve disposed on an upper portion of the drilling system, according to one or more embodiments.

FIG. 3A shows a schematic view of the drilling system 300 including a tubing joint 308 of the drill pipe with a sensor sleeve 302 attached to an upper portion of the tubing joint 308. How the sensor sleeve 302 is attached to the tubing joint 308 is described in step 902 of the flowchart shown in FIG. 9.

The sensor sleeve 302 includes a housing (311 in FIG. 3C) that is stable enough to withstand the flow of the drilling fluid and collisions with drill cuttings. Therefore, the housing may be made of a metal (e.g., stainless steel or carbon steel) or a resilient plastic.

The sensor sleeve 302 includes a transmitter 310 that transmits a sensing signal. The sensing signal may be an optical sensing signal, an electromagnetic sensing signal, or an acoustic sensing signal.

In some embodiments, the transmitter 310 is an optical transmitter, such as an optical diode, a complementary metal-oxide-semiconductor (CMOS), or a camera sensor. In other embodiments, the transmitter 310 is an electromagnetic transmitter, such as a coil, or an antenna. Yet in other embodiments, the transmitter 310 is an acoustic transmitter, such as an acoustic transducer, or a microphone.

In one or more embodiments, the CMOS is a metal-oxide-semiconductor field-effect transistor (MOSFET). In one or more embodiments, the camera sensor is a digital image sensor. In one or more embodiments, the digital image sensor is a charge-coupled device (CCD) or an active-pixel sensor (CMOS sensor).

The sensor sleeve 302 further includes a receiver, integrated with the transmitter 310, that receives the sensing signal. In some embodiments, the receiver is an optical receiver, such as an optical diode, a complementary metal-oxide-semiconductor (CMOS), or a camera sensor. In other embodiments, the receiver is an electromagnetic receiver, such as a coil, or an antenna. Yet in other embodiments, the receiver is an acoustic receiver, such as a microphone.

Figure 8:
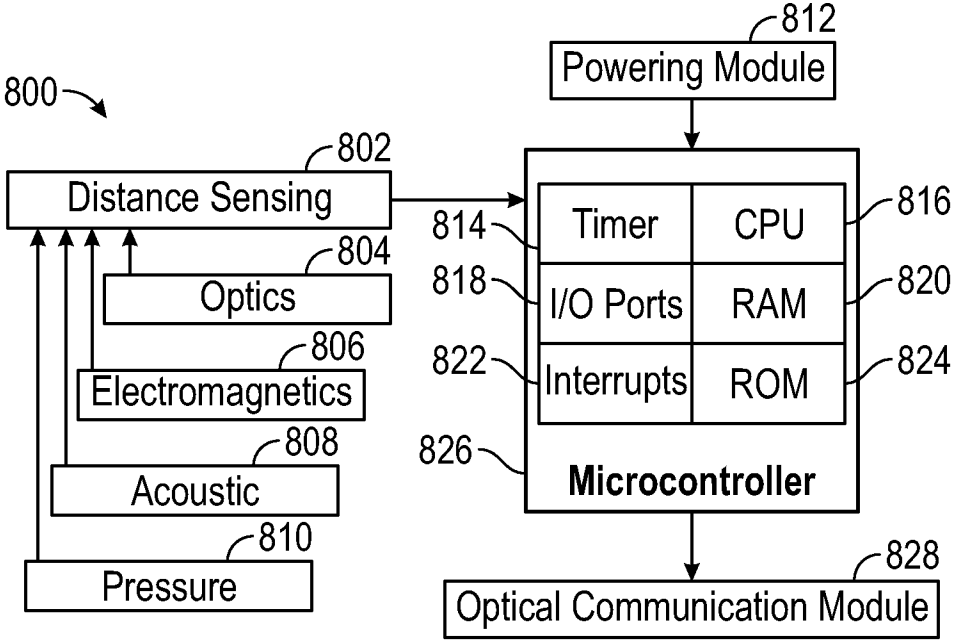
FIG. 8 shows a schematic view of the repeater of the drilling system, according to one or more embodiments.

The sensor sleeve also includes a repeater which is described in the description of FIG. 8.

In FIG. 3A, the sensor sleeve 302 is attached to the tubing joint 308 at a neck 304 of the tubing joint 308. The neck 304 without the sensor sleeve is shown in FIG. 3B. An outer surface of the neck 304 is shaped such that the inner walls of the sensor sleeve 302 fits the neck 304 with minimal freedom of movement of the sensor sleeve 302 when positioned in the neck 304. By having the sensor sleeve 302 at the neck 304, the sensor sleeve 302 may have increased machinal protection from a movement of the tubing joint 308 against a wellbore or casing.

FIG. 3B shows a schematic view of the drilling system 300 of FIG. 3A with the sensor sleeve attached to a middle portion 306 of the tubing joint 308. The middle portion 306 without the sensor sleeve 302 is shown in FIG. 3A. The middle portion 306 has the smallest diameter along the tubing joint 308. Therefore, the sensor sleeve 302 with a flexible component may be attached to the tubing joint 308 at the middle portion 306 easily. By having the sensor sleeve 302 at the middle portion 306, the sensor sleeve 302 may have increased clearance for signal transmission to and from the sensor sleeve 302.

FIG. 3C shows a cross-sectional view of the sensor sleeve 302. The housing 311 of the sensor sleeve 302 extends axially along an axis As from a first end 302*a* to a second end 302*b*. Additionally, the housing 311 is defined by a first wall 312 radial spaced from a second wall 313 and two end walls 314 connected the first wall 312 and the second wall 313. The first wall 312 defines a bore of the sensor sleeve 302 to receive the tubing joint. Additionally, the first wall 312 forms the inner walls of the sensor sleeve 302 which may be shaped have a profile to match a profile of the tubing joint. The second wall defines an outer surface of the sensor sleeve 302. The two end walls 314 define end surfaces of the sensor sleeve 302 at the first end 302*a* and the second end 302*b*.

As shown in FIG. 3C, the housing 311 of the sensor sleeve 302 may house various components, such as sensitive electronics, to provide protection from a wellbore environment. For example, a battery 316, a printed circuit board (PCB) 317, various supporting integrated circuits (e.g., power management, filters) and passive components (e.g., resisters and capacitors) and sensors 318, and a microcontroller 319 may be provided in the housing 311. Additionally, the transmitter 310, with the receiver integrated therein, may be partially disposed in the housing 311. Fr example, the transmitter 310 may extend out of the housing 311 for better transmission of signals.

Figure 4:
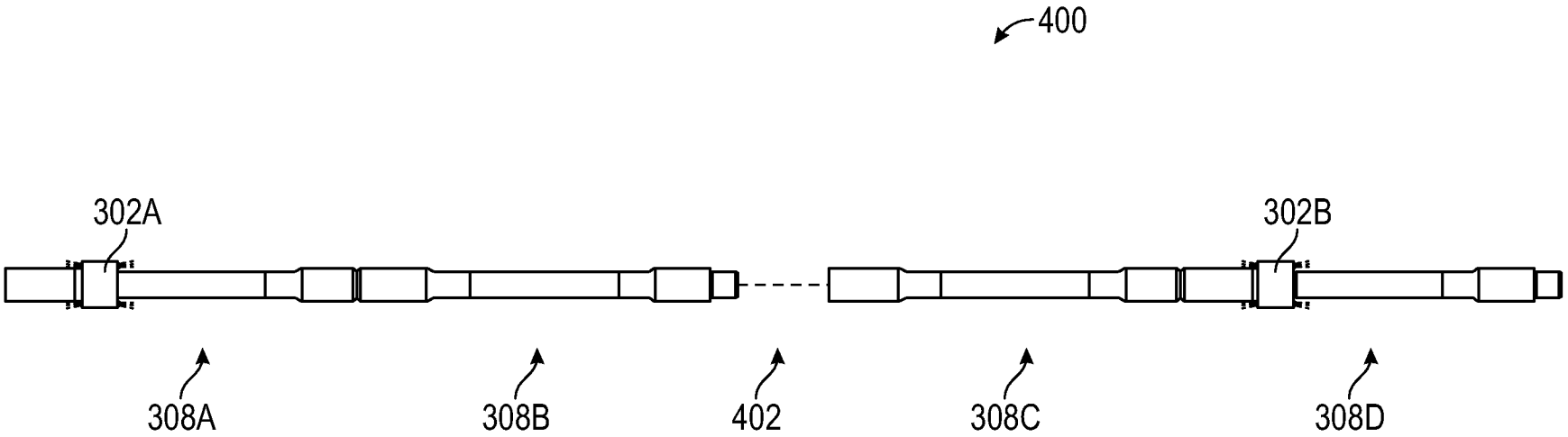
FIG. 4 shows a drilling system with a drill pipe and a sensor sleeve installed at a tubing joint and a sensor sleeve installed next to a tubing joint, according to one or more embodiments.

FIG. 4 shows a drilling system 400 with several tubing joints 308A, 308B, 308C. 308D connected to each other lengthwise. The tubing joints 308A, 308B, 308C, 308D are around 9 m (30 ft) long with a thread connection on each end to be connected to the neighboring tubing joint. The stand of the drilling system 400 is a section of 2 or 3 tubing joints connected and stays upright in the derrick (see description of FIG. 1).

The first tubing joint 308A on the left side of FIG. 4 includes a first sensor sleeve 302A at the neck of the first tubing joint 308A similar to FIG. 3A. The second tubing joint 308B on the right of the first tubing joint 308A does not include a sensor sleeve 302. The dotted line 402 represents more tubing joints that are not shown in FIG. 4. The last tubing joint 308D on the right includes a second sensor sleeve 302B on the neck of the last tubing joint 308D similar to FIG. 3A. The tubing joint 308C before the last tubing joint 308D shown on the right of the dotted line 402 also does not include a sensor sleeve.

The number of the tubing joints may be anywhere between one tubing joint to a hundred tubing joints of the drill pipe depending on the wellbore geometry.

The drilling system 400 includes a tally which is a list containing the number of each tubing joint, details, lengths, and other pertinent details of the tubing joints. Each repeater has its unique ID number that is correlated to the tally of the drill pipe. For example, the unique ID number is assigned to each repeater which is recognizable during the installation and running of the drill pipes. The tally is created as a record to keep an order of how the drill pipe is installed. With the unique ID number, the repeater position can be marked easily during the preparation of the tally. Thus, the position or depth of each repeater may be identified at any time in case the unique ID number of the repeaters are provided.

The number of the sensor sleeves to be installed on the drill pipe varies depending on the well geometry and required system redundancy. The spacing between the neighboring sensor sleeves may be anywhere between one tubing joint to a hundred tubing joints of the drill pipes.

Figure 5:
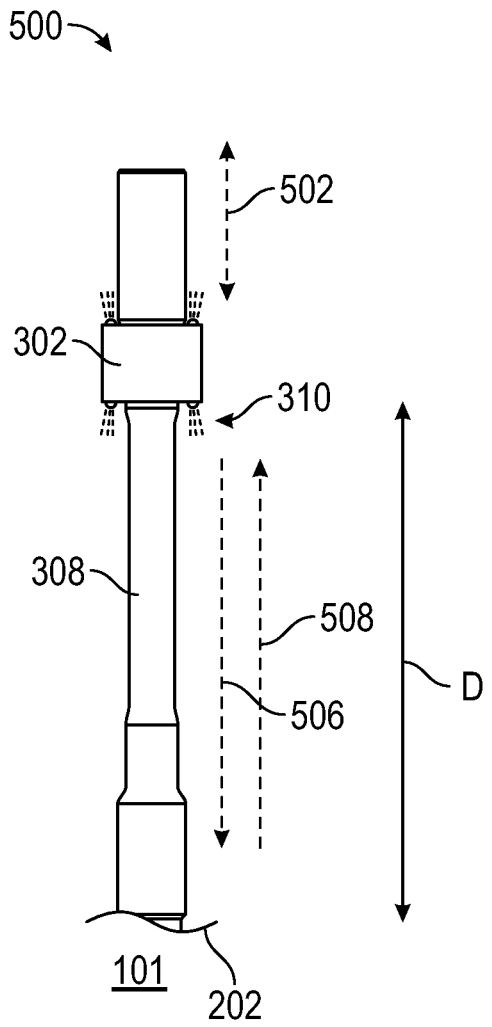
FIG. 5 shows a drilling system with a drill pipe that detects the fluid level, according to one or more embodiments.

FIG. 5 shows a drilling system 500 that detects the fluid level. The drilling system 500 includes several tubing joints, however, only the tubing joint 308 that is partly immersed in the drilling fluid 101 is shown. The tubing joint 308 includes a sensor sleeve 302 on the neck of the tubing joint 308 similar to FIG. 3A. A lower portion of the tubing joint 308 is below a fluid level 202 of the drilling fluid 101. The sensor sleeve 302 shown in FIG. 5 is nearest to and above the fluid level 202.

A sensing signal 506 transmitted by the transmitter 310 of the sensor sleeve is reflected on a surface of the drilling fluid 101 and is received by the receiver of the sensor sleeve 302 (not shown in FIG. 5).

The time of flight of the sensing signal is the time between transmitting the sensing signal 506 by the transmitter 310 and receiving the reflected sensing signal 508 by the receiver. In some embodiments, a distance D between the sensor sleeve 302 and the fluid level 202 of the drilling fluid 101 is determined from the time of flight of the sensing signal. The distance D is equal to the speed $v_{signal}$ of the sensing signal in air multiplied by the time of flight $t_{flight}$ of the sensing signal: $D=v_{signal}*t_{flight}$.

When the sensing signal 506 transmitted by the transmitter 310 is reflected on the surface of the drilling fluid 101, the reflected sensing signal 508 has a different phase than the sensing signal 506 transmitted by the transmitter 310. In other words, the sensing signal shifts phase when reflected on the surface of the drilling fluid 101. In some embodiments, the distance D is measured by the phase shift of the sensing signals when reflected on the surface of the fluid.

Furthermore, when the sensing signal 506 transmitted by the transmitter 310 is reflected on the surface of the drilling fluid 101, the reflected sensing signal 508 has a smaller amplitude than the sensing signal 506 transmitted by the transmitter 310. The decrease in amplitude results from an attenuation of the sensing signal when the sensing signal is reflected on the surface of the drilling fluid. In some embodiments, the distance D is measured by the attenuation of the sensing signal when reflected on the fluid surface.

A fluid level offset is determined by the sensor sleeve that has the closest proximity to the fluid level. Once the fluid level offset is determined, the fluid level is a sum of the fluid level offset and the position of the sensor.

Figure 6:
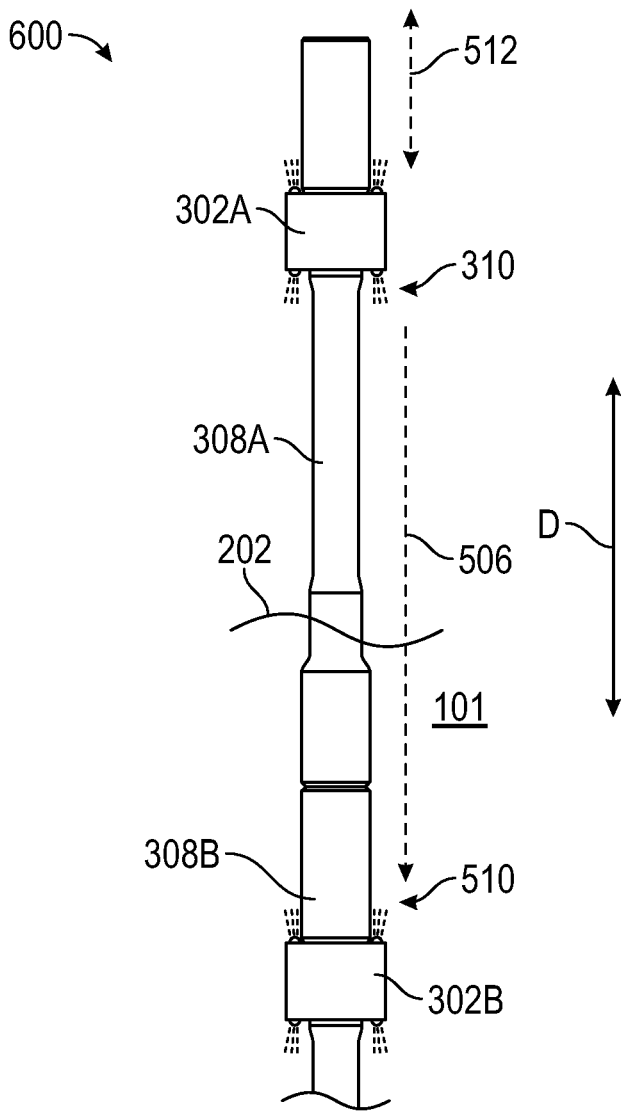
FIG. 6 shows another drilling system with a drill pipe that detects the fluid level, according to one or more embodiments.

FIG. 6 shows another drilling system 600 that detects the fluid level. The drilling system 600 includes several tubing joints, however, only two of the tubing joints 308A, 308B are shown in FIG. 6. The first tubing joint 308A is connected to the second tubing joint 308B lengthwise. The first tubing joint 308A is placed on top of the second tubing joint 308B. The fluid level 202 of the drilling fluid 101 is at the first tubing joint 308A. The second tubing joint 308B is completely immersed in drilling fluid 101.

A first sensor sleeve 302A is attached to an upper neck of the first tubing joint 308A, similar to FIGS. 3A and 5. The first sensor sleeve 302A is above and nearest to the fluid level 202. A second sensor sleeve 302B is attached to an upper neck of the second tubing joint 308B, similar to FIGS. 3A and 5. The second sensor sleeve 302B is nearest to and below the fluid level 202. The first sensor sleeve 302A includes a transmitter 310 and the second sensor sleeve 302B includes a receiver 510.

The transmitter 310 transmits a sensing signal 506 in a direction of the drilling fluid 101. The transmitted sensing signal 506 immerges in the drilling fluid 101 and is then received by the receiver 510. The distance D between the first sensor sleeve 302 and the fluid level 202 is determined by the attenuation of the sensing signal 506 when passing through the drilling fluid 101. Once the distance D is determined, the first sensor sleeve 302A sends a communication signal 512 including the distance D to the sensor sleeve of the tubing joint neighboring the first tubing joint 308A above. Sending the communication signal to the sensor sleeve of the neighboring tubing joint above is repeated until the distance D reaches the surface of the wellbore, where the distance D is readable by an operator in order to regulate the flow of the drilling fluid from the mud.

Figure 7:
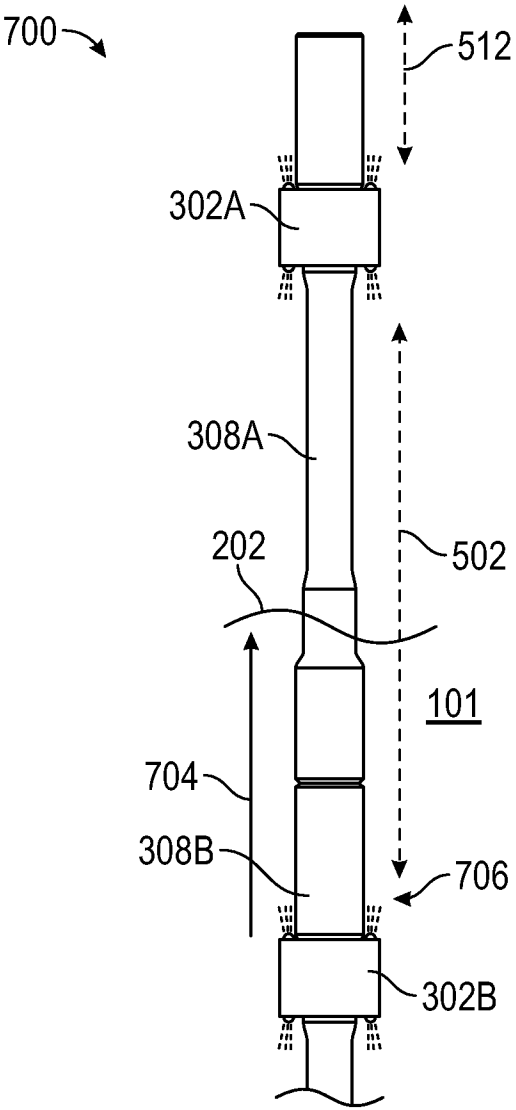
FIG. 7 shows another drilling system with a drill pipe that detects the fluid level, according to one or more embodiments.

FIG. 7 shows another drilling system 700 that detects the fluid level.

This drilling system 700 is similar to the drilling system 600 of FIG. 6, except that the second sensor sleeve 302B also includes a pressure gauge 706 that measures the hydrostatic pressure of the drilling fluid 101.

The fluid level is calculated from the measured hydrostatic pressure at the depth of the second sensor sleeve 302B and the known fluid density. The depth h is determined by $$h = \frac{p}{\rho \cdot g},$$

where p is liquid pressure, g is gravity, and p is the density of the drilling fluid.

FIG. 8 shows a schematic view of the repeater 800. The repeater is an electronic module equipped with an on-board powering module 812, a microcontroller 826, an optical communication module 828, and a distance sensing module 802. The data including the fluid level and the fluid level offset is transmitted among the repeaters by mean of optical communication. The repeater is an electronic telecommunication device that receives a signal and retransmits the signal. The repeater is used to extend transmission to the transmitters of the neighboring sensor sleeves. This way the signal may cover longer distances or be received on the other side of an obstruction. In one or more embodiments, the repeater broadcasts an identical signal. In other embodiments, the repeater alters the frequency or baud rate of the received signal.

The distance sensing module 802 measures the distance to the fluid level offset based on one or more measurement techniques including optics 804, electromagnetics 806, acoustic 808, and pressure 810. For example, a time of flight signal of the optics 804 or the acoustic 808 to and from the distance sensing module 802 to the fluid level offset may determine the distance. A signal attenuation of the electromagnetics 806 may determine the distance. The pressure 810 to determine the distance may be based on hydrostatic pressure when a pressure sensor is submerged and pipe in a vertical configuration.

The powering module 812 powers the microcontroller 826. In one or more embodiments, the powering module 812 includes a battery or a battery pack. The microcontroller 826 includes a timer 814, a CPU 816, I/O ports 818, a RAM 820, interrupts 822, and a ROM 824 to ensure a running of a program in the microcontroller 826 to execute an application.

The repeater 800 identifies the sensor sleeve next to the fluid level and measures the distance between the repeater 800 and the fluid level offset. Then the repeater 800 sends the data upwards to the next repeater or next few repeaters in the case of a redundant system design.

The distance sensing module 802 provides data to the microcontroller 826 to identify the repeater 800 of the sensor sleeve next to the fluid level. After the repeater 800 of the sensor sleeve next to the fluid level is identified and the distance to the fluid level offset is obtained, the data is transmitted to the surface through the chains of the repeaters via the optical communication module 828.

Figure 9:
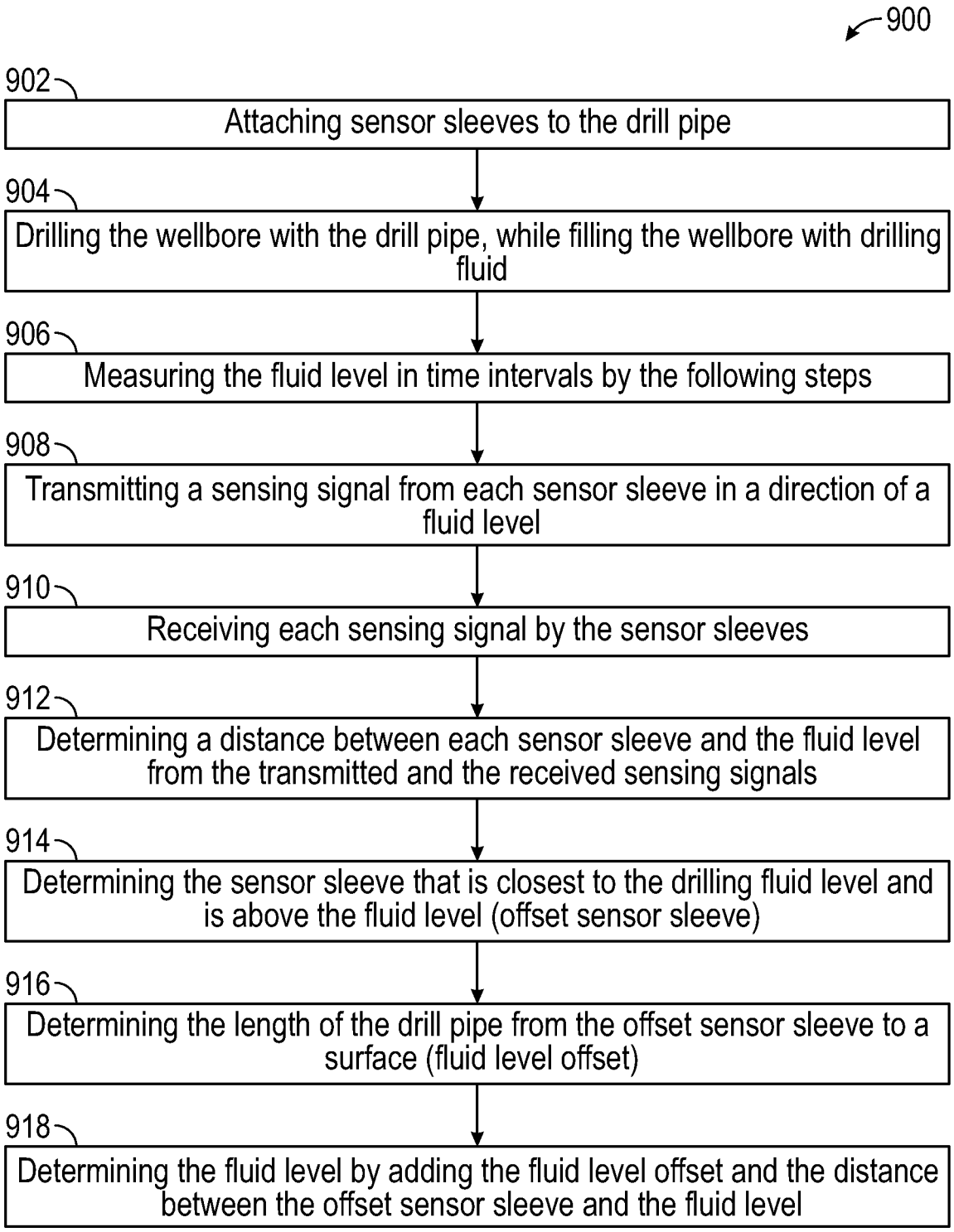
FIG. 9 shows a flowchart of the method steps to measure a fluid level in a wellbore during drilling of the wellbore.

FIG. 9 shows a flowchart 900 of the method steps to measure a fluid level in a wellbore during drilling of the wellbore. The method steps include the following steps.

In a first step 902, sensor sleeves are attached to the drill pipe.

The sensor sleeves 302 are shaped tubularly with a length along the tubing joint 308 being larger than a width across the tubing joint 308. The sensor sleeves 302 may be attached to the tubing joint 308 at any place along the length of the tubing joint 308. The sensor sleeve 302 may be completely rigid or may have a flexible component. In case of a sensor sleeve 302 with a flexible component, the flexible component is stretched and the sensor sleeve is moved along the tubing joint 308. Once the sensor sleeve 302 reaches the position along the tubing joint 308 where the sensor sleeve 302 needs to be attached to the tubing joint 308, the flexible component is released to tighten the sensor sleeve 302 to the tubing joint 308.

In case of a completely rigid sensor sleeve 302, the sensor sleeve 302 may be attached to the tubing joint 308 by any means, such as screwing, welding, brazing, or soldering. In some embodiments, the sensor sleeve 302 may include two parts that are hinged with each other such that the sensor sleeve 302 may be opened and closed by the two parts.

Next, in step 904, the wellbore is drilled with the drill pipe, while the wellbore is filled with drilling fluid.

In order to drill the wellbore, the drill bit starts spinning as soon as the drill bit touches the surface of the ground. The drill bit cuts its way through the rocks of the formation. During the drilling, drilling fluid is pumped down the wellbore, as described in the next step.

The mud pump suctions drilling fluid from the mud tank as described in the description of FIG. 1. The mud pump pumps the drilling fluid through the standpipe up the derrick and through the kelly hose to the swivel and then down the drill string to the drill bit. Then, the drilling fluid jets out of the drill bit and stream through the annulus upward to the surface carrying the drill cuttings. The mixture of drill cuttings and drilling fluid streams through the flow line to the shale shaker where the drill cuttings are removed from the drilling fluid. From the shale shaker the drilling fluid streams back to the mud tank where the circulation of the drilling fluid starts over.

In step 906, the fluid level is measured in time intervals by the steps 908-918. The time intervals may be any time interval. In some embodiments, the time interval is 10 seconds, 1 minute, 5 minutes, or 10 minutes.

In step 908, a sensing signal is transmitted from each sensor sleeve in a direction of the fluid level. The sensing signal is a pulsed electromagnetic signal. Each sensing signal has an identifier that identifies the sensor sleeve that transmitted the sensing signal. The identifier may be a code that is part of the sensing signal.

In step 910, each sensing signal is received by the sensor sleeves.

Each sensor sleeve identifies the sensor sleeve that transmitted the sensing signal by the identifier of the received sensing signal.

In step 912, a distance between each sensor sleeve and the fluid level is determined from the transmitted and the received sensing signals.

In some embodiments, the transmitted sensing signal is reflected on the surface of the fluid and then received by a receiver of the same sensor sleeve. This case is similar to the case of FIG. 5. In this case, the fluid level is determined by the time of flight of the sensing signal.

In other embodiments, the transmitted sensing signal immerges into the drilling fluid and is received by a receiver of a sensor sleeve that is below the fluid level. This case is similar to the case of FIG. 7. In this case the fluid level is measured by the attenuation of the sensing signal.

In step 914, the sensor sleeve that is closest to the drilling fluid level and is above the fluid level (offset sensor sleeve) is determined. For example, if out of an X number of sensor sleeves from top to bottom, an Y number of sensor sleeves are identified as submerged, the closest to and above the fluid level is the sensor sleeve number from subtracting Y from X. In some embodiments, each sensor sleeve has a sensor to detect whether the sensor sleeve is submerged. The sensor may be a wet sensor, a fluid detection sensor, or a pressure sensor.

In step 916, the length of the drill pipe from the offset sensor sleeve to a surface (fluid level offset) is determined.

In some embodiments, the drill pipe includes tubing joints (see description of FIG. 4) and the sensor sleeves are attached to the tubing joints.

In some embodiments, the drill pipe includes a tally, and each sensor sleeve includes a unique ID number that is correlated to the tally for identifying a position of the sensor sleeve along the drill pipe.

The offset sensor sleeve is identified by its ID number. After the offset sensor sleeve is identified, the sensor sleeves above the offset sensor sleeve are counted. The number of the sensor sleeves above the offset sensor sleeve and their length determines the length of the drill pipe from the offset sensor sleeve to a surface (fluid level offset).

In step 918, the fluid level is determined by adding the fluid level offset and the distance between the offset sensor sleeve and the fluid level. Exemplary, it is assumed that the sensor sleeve nearest to and above the fluid level determines a distance D of about 1.5 m (5 ft) and the number of the sensor sleeves that are above the sensor sleeve nearest to and above the fluid level is 60. In case each of the sensor sleeves has a length of around 9 m (30 ft), the length of the drill pipe from the offset sensor sleeve to a surface (fluid level offset) is equal to 60·9 m (30 ft)=540 m (1800 ft). Adding the 1.5 m (5 ft) to the 540 m (1800 ft) results in a fluid level of 541.5 m (1805 ft).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A drilling system that measures a fluid level in a wellbore, comprising:
- a drill pipe; and
- a sensor sleeve attached to the drill pipe, the sensor sleeve comprising:
  - a transmitter that transmits a sensing signal in a direction of a fluid in the wellbore,
  - a receiver that receives the sensing signal after the sensing signal is reflected on a surface of the fluid, and
  - a repeater that determines a distance between the sensor sleeve and the fluid level from the transmitted and received sensing signal,
- wherein the fluid level in the wellbore is calculated using the distance determined by the repeater and a distance between the sensor sleeve and a surface of the wellbore,
- wherein the repeater determines the distance between the sensor sleeve and the fluid level from at least one of a time of flight of the sensing signal or an attenuation of the sensing signal.

2. The drilling system according to claim 1, wherein the repeater determines the distance between the sensor sleeve and the fluid level from a phase shift of the sensing signal.

3. The drilling system according to claim 1, wherein the sensing signal is an optical signal, an electromagnetic signal, or an acoustic signal.

4. The drilling system according to claim 1, wherein the transmitter is an optical diode, a complementary metal-oxide-semiconductor (CMOS), a camera sensor, an electromagnetic transmitter, or an acoustic transmitter.

5. The drilling system according to claim 4, wherein the acoustic transmitter is an acoustic transducer.

6. The drilling system according to claim 4, wherein the electromagnetic transmitter is a coil.

7. The drilling system according to claim 1, wherein the receiver is an optical diode, a complementary metal-oxide-semiconductor (CMOS), a camera sensor, an electromagnetic receiver, or an acoustic receiver.

8. The drilling system according to claim 7, wherein the electromagnetic receiver is an antenna.

9. The drilling system according to claim 7, wherein the acoustic receiver is a microphone.

10. The drilling system according to claim 1, wherein the repeater is a telephone repeater, an optical repeater, a radio repeater, or a broadcast relay station.

11. The drilling system according to claim 1, wherein the drill pipe further comprises a tubing joint and the sensor sleeve is attached to the tubing joint.

12. A drilling system that measures a fluid level in a wellbore, comprising:
- a drill pipe comprising a plurality of sensor sleeves attached to the drill pipe, the drill pipe being configured to be lowered into the wellbore where a drilling fluid circulates, wherein each of the plurality of sensor sleeves comprise:
  - a pressure gauge that measures a hydrostatic pressure of the drilling fluid in the wellbore, and
  - a repeater that determines a depth of the sensor sleeve in the drilling fluid based on the hydrostatic pressure and a density of the drilling fluid, wherein each repeater comprises an ID number that identifies a position of each repeater along the drill pipe.

13. A method of measuring a fluid level in a wellbore during drilling of the wellbore using a drilling system comprising a drill pipe, the method comprising:
- attaching a plurality of sensor sleeves along the drill pipe,
- drilling the wellbore with the drill pipe, while filling the wellbore with drilling fluid,
- measuring the fluid level in the wellbore in time intervals by:
  - transmitting a sensing signal from each sensor sleeve in a direction of the fluid level,
  - receiving, by the plurality of sensor sleeves, each sensing signal reflected on the surface of the drilling fluid,
  - determining a distance between each sensor sleeve and the fluid level from the transmitted and received sensing signals,
  - determining the sensor sleeve that is closest to and above the fluid level, called the offset sensor sleeve, determining a fluid level offset, wherein the fluid level offset is a length of the drill pipe from the offset sensor sleeve to a surface of the wellbore, and determining the fluid level by adding the fluid level offset and the distance between the offset sensor sleeve and the fluid level.

14. The method according to claim 13, wherein the drill pipe comprises tubing joints, the plurality of sensor sleeves are attached to the tubing joints, and the drilling system further comprises:

a tally that lists a number and a length for each tubing joint, and a repeater that performs the steps for measuring the fluid level in time intervals, each repeater comprises an ID number that identifies a position of each repeater along the drill pipe, and the fluid level offset is determined by adding the lengths of the tubing joints that are above the tubing joint with the offset sensor sleeve.

15. The method according to claim 13, wherein the drill pipe further comprises at least one hundred tubing joints.

16. The method according to claim 13, wherein each sensor sleeve comprises a repeater that determines the distance between the sensor sleeve and the fluid level, and wherein the repeaters of the sensor sleeves are coupled, such that a communication signal comprising the fluid level is transmitted to a neighboring sensor sleeve until the communication signal reaches the surface of the wellbore.

* * * * *